United States Patent [19]

Tomizu et al.

[11] Patent Number: 4,808,122

[45] Date of Patent: Feb. 28, 1989

[54] CABLE CONNECTOR WITH STEPPED CONNECTING ELEMENT

[75] Inventors: Motoyuki Tomizu, Otokuni; Yasuhiro Okada, Takatsuki, both of Japan

[73] Assignee: Omron Tateisi Electronics Co., Kyoto, Japan

[21] Appl. No.: 889,864

[22] Filed: Jul. 28, 1986

[30] Foreign Application Priority Data

Aug. 5, 1985 [JP] Japan ..... 60-120674[U]

[51] Int. Cl.[4] ..... H01R 11/20

[52] U.S. Cl. ..... 439/417; 439/395; 439/404

[58] Field of Search ..... 339/97 R, 97 P, 98, 339/99 R; 439/389, 391, 395–408, 417

[56] References Cited

U.S. PATENT DOCUMENTS

| | | | |
|---|---|---|---|
| 3,820,055 | 6/1974 | Huffnagle et al. | 339/97 P X |
| 4,066,316 | 1/1978 | Rollings | 339/99 R X |
| 4,241,970 | 12/1980 | Rider, Jr. et al. | 339/99 R |
| 4,464,002 | 8/1984 | Suzuki et al. | 339/97 P |
| 4,560,226 | 12/1985 | Dennis | 339/99 R |

*Primary Examiner*—Eugene F. Desmond
*Attorney, Agent, or Firm*—Stevens, Davis, Miller & Mosher

[57] ABSTRACT

In this cable connector, there are included a main housing formed with a first aperture, a cover formed with a slot for cable insertion and a second aperture opening to the slot, a means for fixing the cover to the main housing, and a cable connecting element formed as an elongate member. One end of this cable connecting element is adapted to be connected to a cable when pressed against it, for example by being bifurcated, the other end of this cable connecting element is adapted for external terminal contact as for example by being springy, an intermediate portion of this cable connecting element is adapted for press fitting as for example being widened, and a step portion of this cable connecting element between the intermediate portion thereof and the cable connection end thereof functions to perpendicularly displace the plane of the intermediate portion from the plane of the cable connection end. The cable connecting element is fitted into the first aperture of the main housing with its intermediate portion being press fitted into the first aperture and its external terminal contact end being housed in that first aperture, and with its the cable connection end protruding out from the first aperture for insertion into the second aperture of the cover and for being coupled to a cable inserted into the slot thereof, when the cover is secured to the main housing by the fixing means.

5 Claims, 3 Drawing Sheets

CABLE CONNECTOR WITH STEPPED CONNECTING ELEMENT

BACKGROUND OF THE INVENTION

The present invention relates to a cable connector, and more particularly relates to such a cable connector, in which the configuration of an element for being connected to a cable such as a flat ribbon type cable to which said connector is coupled is improved over the prior art.

A typical prior art type cable connector is shown in FIG. 4A of the accompanying drawings in transverse sectional view. In such a cable connector, a main housing 101 is formed with an aperture 106 in which there is inserted a cable connection element 102. This cable connection element 102 is formed with its lower end 102*a* bifurcate, as shown in FIG. 4B, and is fitted into the aperture 106 with its upper portion 102*b*, which is a terminal connection portion, housed in the deeper portion of said aperture 106, and with its intermediate portion 102*c* being press fitted into the outer portion of said aperture 106. In this state, the lower bifurcate end portion 102*a* of said cable connection element 102 projects outwardly and downwardly from the point of view of the figure from the main housing 101. A cover member 103 is formed with a slot 103*a*, into which is fitted the end of a flat ribbon type cable 105 to which connection is to be made. Then the cover member 103 with the cable 105 thus fitted into its slot 105 is pressed against the main housing 101, and at this time the bifurcate end portion 102*a* of the cable connection element 102 enters into an aperture 104 formed in the cover member 103 and cuts into the outer housing of the cable 105, in more detail into the outer housing of an appropriate one of a plurality of wire elements making up said cable 105 to which this cable connection element 102 is to be electrically connected, and makes contact with the electrically conductive core of said wire element. Then the cover 103 is secured by a clip construction denoted as 107 to the main housing 101, and accordingly the cable connector as a whole is fixed to the end of the cable 105. Of course, in practice a plurality of these cable connection elements 102 are provided to the cable connector, but since they are arranged in a line in a direction perpendicular to the drawing paper in FIG. 4 only one such cable connection element 102 can be seen in that figure. And, during use of this cable and cable connector which is a female type cable connector, a prong of a male connector (not particularly shown) is inserted into the upper end in FIG. 4A of the aperture 106 of the main connector housing 101, and makes contact with the terminal connection portion 102*b* of the cable connection element 102, said terminal connection portion 102*b* being formed as springy for ensuring good and reliable contact over a long service life.

However, a problem with this type of prior art cable connector is that, because the cable connection element 102 has been formed as a generally planar element all on one level, the force exerted on said cable connection element 102 when fitting the cable 105 and the cover 103 to the main housing 101 which is inevitably exerted when the bifurcate end portion 102*a* of said cable connection element 102 bites into and tears and rips the outer integument of the cable 105 is inevitably transmitted to the intermediate portion 102*c* of said cable connection element 102 and to the press fitting engagement thereof into the outer portion of the aperture 106. If, therefore, this press fitting engagement should slip, there is a risk of deformation of the cable connection element 102, particularly of deformation of the upper terminal connection portion 102*b* thereof; and this in the worst case can lead to poor contact performance and to failure of operation of the cable connector.

SUMMARY OF THE INVENTION

Accordingly, it is the primary object of the present invention to provide a cable connector, which avoids the problems detailed above.

It is a further object of the present invention to provide such a cable connector, which is reliable during use.

It is a further object of the present invention to provide such a cable connector, which is easy to fit to a cable.

It is a further object of the present invention to provide such a cable connector, which does not suffer any substantial risk of deformation of parts thereof, while it is being fitted to a cable.

It is a further object of the present invention to provide such a cable connector, which is not prone to bad contacting performance.

It is a yet further object of the present invention to provide such a cable connector, in which force arising from fixing thereof to a cable is well and effectively absorbed without causing any substantial problems.

It is a yet further object of the present invention to provide such a cable connector, which only requires simple equipment for being fitted to a cable.

According to the most general aspect of the present invention, these and other objects are attained by a cable connector, comprising: (a) a main housing formed with a first aperture; (b) a cover formed with a slot for cable insertion and a second aperture opening to said slot; (c) a means for fixing said cover to said main housing; (d) a cable connecting element formed as an elongate member, one end thereof being adapted to be connected to a cable when pressed thereagainst, the other end thereof being adapted for external terminal contact, an intermediate portion thereof being adapted for press fitting, and a step portion thereof between said intermediate portion thereof and said cable connection end thereof functioning to perpendicularly displace the plane of said intermediate portion thereof from the plane of said cable connection end thereof; (e) said cable connecting element being fitted into said first aperture of said main housing with its said intermediate portion being press fitted into said first aperture and its said external terminal contact end being housed in said first aperture, and with its said cable connection end protruding out from said first aperture for insertion into said second aperture of said cover and for coupling to a cable inserted into said slot of said cover, when said cover is secured to said main housing by said fixing means therefor.

According to such a cable connector as specified above, since the cable connection element is formed with the step portion, this step portion rests against the outer surface of the main housing, and thus the force, which is inevitably exerted on the cable connection element when fitting the cover and a cable inserted in its slot to the main housing as the cable connection end portion of said cable connection element becomes forcibly connected to the cable, is simply absorbed by the step portion pressing against the outer surface of the main housing. Thus, there is no substantial risk of causing the press fitting engagement of the intermediate portion of said cable connection element into said first aperture to be broken or slip, and hence no substantial risk of deformation of the external terminal contact end of said cable connection element is generated. Thus bad contacting performance thereof is militated against. Thus, further, according to a particular specialization of the present invention, the above specified and other objects are more particularly attained by a cable connector as specified above, wherein said step portion of said cable connecting element rests against the outside side of said main housing. And, more preferably, according to another particular specialization of the present invention, the above specified and other objects are more particularly attained by a cable connector, wherein said step portion of said cable connecting element rests in a depression formed in the outside side of said main housing.

BRIEF DESCRIPTION OF THE DRAWINGS

The present invention will now be described with respect to the preferred embodiment thereof, and with reference to the illustrative drawings appended hereto, which however are provided for the purposes of explanation and exemplification only, and are not intended to be limitative of the scope of the present invention in any way. With relation to the figures, spatial terms are to be understood as referring only to the orientation on the drawing paper of the illustrations of the relevant parts, unless otherwise specified; like reference numerals, unless otherwise so specified, denote the same parts and gaps and spaces and so on in the various figures; and.

DESCRIPTION OF THE PREFERRED EMBODIMENT

Figure 1:
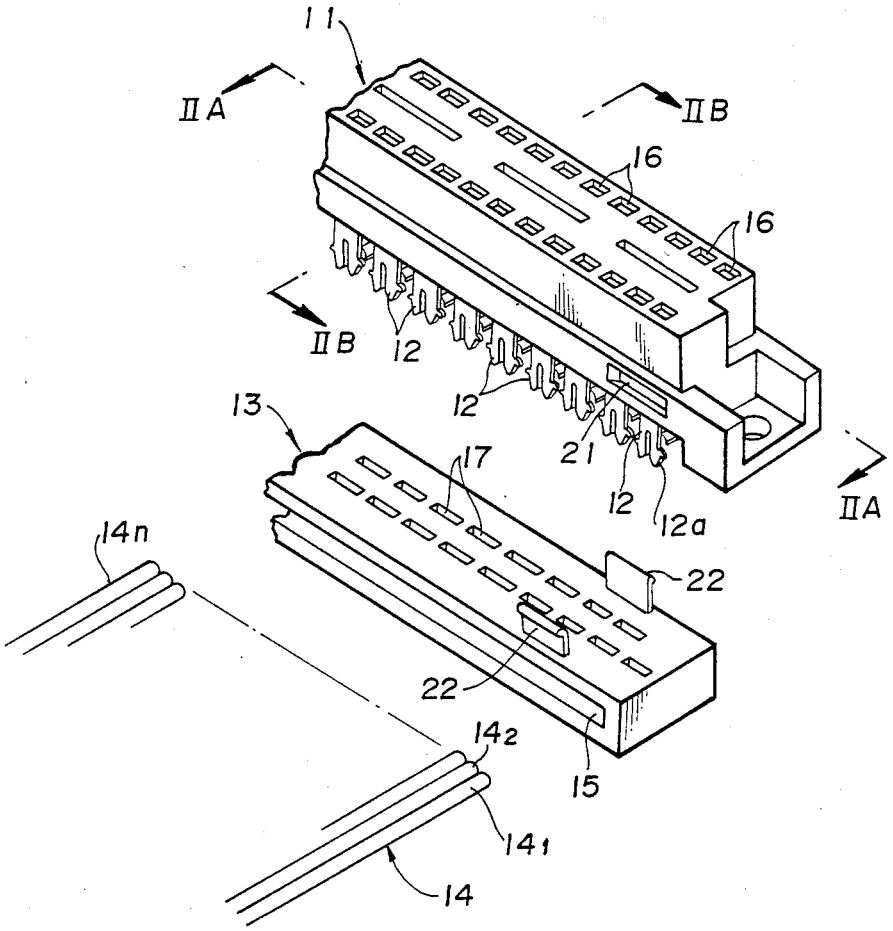
FIG. 1 is an exploded perspective view showing the preferred embodiment of the cable connector of the present invention, as well as showing an exemplary ribbon cable to which said prefered embodiment type cable connector is to be fitted.

The present invention will now be described with reference to the preferred embodiment thereof, and with reference to the figures. FIGS. 1 through 3 show various views of the preferred embodiment of the cable connector of the present invention. Referring to FIG. 1, the reference numeral 11 therein denotes a main housing of the cable connector, and the reference numeral 12 denotes the various ones of a plurality of cable connecting elements received therein, while the reference numeral 13 denotes a cover for this cable connector, and the reference numeral 14 denotes an exemplary flat ribbon type cable to which this connector is to be fitted.

In detail, the connector main housing 11 is made of a material such as synthetic resin or the like, and is formed in an elongated shape with a plurality of apertures 16 being formed in it in two rows, said apertures 16 being for receiving the cable connecting elements 12 into them and for, during use of this cable connector which is in fact a female type connector, receiving prongs extending from a male type connector, not particularly shown, mounted to a printed circuit board of a computer or the like, also not shown, for connecting said male type connector via this female type connector to the flat ribbon cable 14.

Meanwhile, in the cover 13 there are formed two rows of apertures 17, corresponding to the ends of these cable connecting elements 12 for receiving them as will be explained shortly. Further, this cover 13 is formed with a plurality of engaging clip portions 22, only two of which can be seen in FIG. 1, which are adapted to clippingly engage into corresponding slots 21 formed on the sides of the main connector housing 11, when the cover 13 is pressed against said main connector housing 11, thus to securely couple together said cover 13 and said main connector housing 11. And one side of the cover 13 is formed with a longitudinally extending slot 15 for receiving the end of the flat ribbon type cable 14 to connect thereto. This flat ribbon type cable 14 is made up from a plurality of cable wires $14_1$, $14_2$, . . . $14_n$ which are adhered side by side, as is per se conventional.

Referring particularly to the perspective view of a typical one thereof shown in FIG. 3, each of the cable connecting elements 12 is made by press forming from an originally flat metal strip, and comprises a bifurcate engaging tip portion **12*a* at its one end, a spring terminal contact portion 12*b* at its other end, a locating press fit portion 12*c* at its central portion, and an offsetting connecting portion 12*d* which connects its said bifurcate engaging tip portion 12*a* to its said central locating press fit portion 12*c*. Thus, particularly according to the inventive concept of the present invention, the bifurcate engaging tip portion 12*a* of each of the cable connecting elements 12 is located in a plane perpendicularly displaced from the rest of the cable connecting element 12 including its central locating press fit portion 12*c* and its spring terminal contact end portion 12*b***.

Figure 2A:
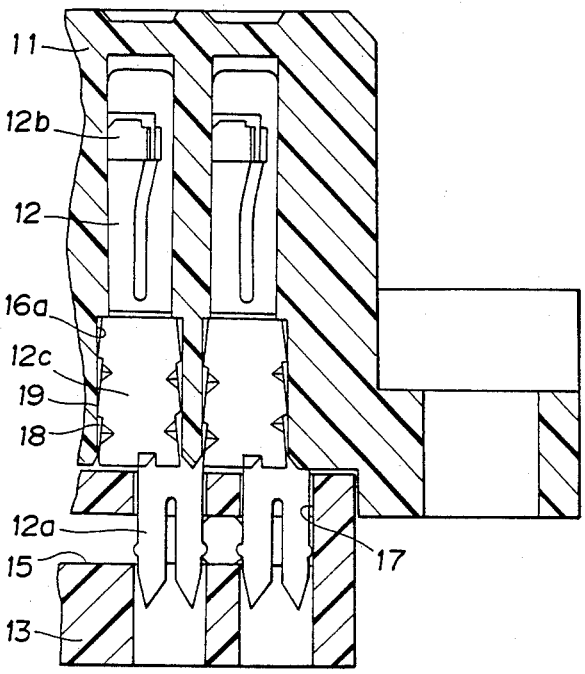
FIG. 2 shows in its FIG. 2A view a longitudinal sectional view of said preferred embodiment cable connector as taken in a sectional plane shown by the arrows IIA—IIA in FIG. 1, and in its FIG. 2B view a transverse sectional view of said preferred embodiment cable connector as taken in a sectional plane shown by the arrows IIB—IIB in FIG. 1.
Figure 2B:
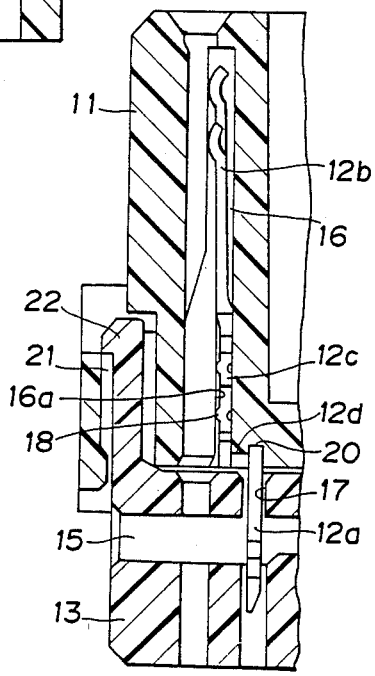
Figure 3:
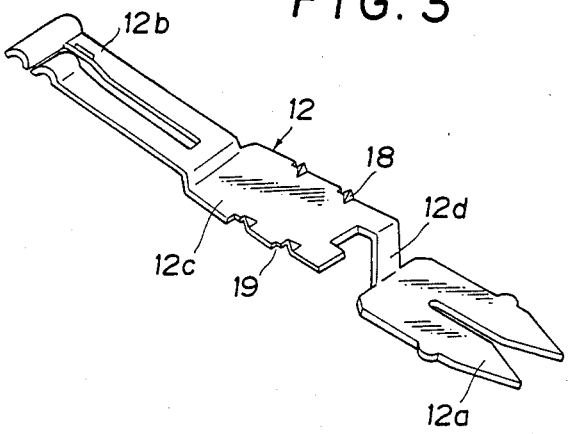
FIG. 3 is a side perspective view showing a typical cable connecting element, formed in an offset or step shape according to the concept of the present invention, a plurality of said cable connecting elements being incorporated in the preferred embodiment cable connector shown in FIGS. 1, 2A, and 2B.
Figure 4A:
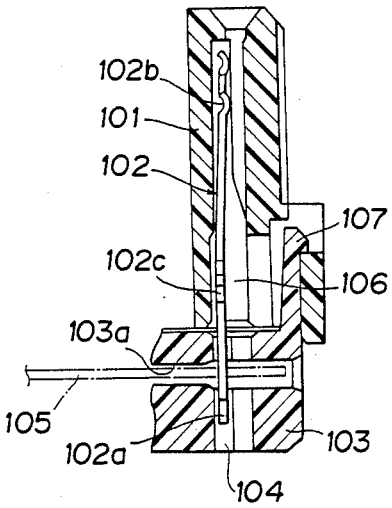
FIG. 4(A) PRIOR ART
FIG. 4, which relates to the prior art, shows in its FIG. 4A view a transverse sectional view of a prior art cable connector, similar to the FIG. 2B view which related to the preferred embodiment of the present invention, and further shows in its FIG. 4B view the engaging tip end portion of a cable connecting element a plurality of which are included in said prior art cable connector.
Figure 4B:
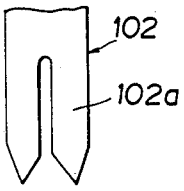
FIG. 4(B) PRIOR ART

Now particularly referring to the sectional views of the connector main housing 11 and the connector cover 13 shown in FIGS. 2A and 2B, in which it can be seen that the apertures 16 formed in said connector main housing 11 are located in a plane similarly perpendicularly offset from the plane of the apertures 17 formed in said connector cover 13, when each of these cable connecting elements 12 is fitted to said connector main housing 11, its spring terminal contact end portion **12*b* is inserted into the appropriate one of the apertures 16, and is pushed thereinto, so that the central locating press fit portion 12*c* of this cable connecting element 12 next comes to be inserted into said aperture 16 and to be likewise pushed thereinto. As clearly visible in FIG. 2A, this central locating press fit portion 12*c* of each of the cable connecting elements 12 is somewhat wider than the corresponding spring terminal contact end portion 12b, and further each of said central locating press fit portions 12c is formed with press formed protrusions 18 and 19 which increase its effective thickness (see FIG. 3). Accordingly, now said central locating press fit portion 12c is wedgingly jammed into the outer end 16a of the aperture 16 which is somewhat wider but shallower than its deeper portion, thus securely holding the cable connecting element 12 in said aperture 16 of the connector main housing 11 with its spring terminal contact end portion 12b proximate to the deep end (the upper end in FIGS. 2A and 2B) of the aperture 16. At this time, the offsetting connecting portion 12d of this cable connecting element 12 rests in a depression 20 formed at the outer end (the lower end in FIGS. 2A and 2B) of said aperture 16, thus securely locating the cable connecting element 12 in the connector main housing 11 and preventing any further pushing in of said cable connecting element 12 into the aperture 16**.

This completes the explanation of how cable connecting elements 12 are fitted to the connector main housing 11. When this female connector is to be fitted to a flat cable such as the ribbon type cable 14 shown in FIG. 1, then first the square cut away end 14 of said ribbon type cable 14 is fitted into the slot 15 of the connector cover 13. Next, while said ribbon type cable 14 is maintained as held in said slot 15 of said connector cover 13, said connector cover 13 is approached to the connector main housing 11 and is pressed thereagainst, with the projecting bifurcate engaging tip portions 12a of the cable connecting elements 12 each entering into the appropriate ones of the apertures 17 in said connector cover 13. As further said connector cover 13 is pressed against said connector main housing 11, typically with the aid of a press tool or the like, each of said bifurcate engaging tip portions 12a of the cable connecting elements 12 rips into the sheath portion of the corresponding one of the cable wires $14_1$, $14_2$, . . . $14_n$ of the flat cable 14, and then makes contact with the central conducting portion of its corresponding said cable wire. And finally, when the cover 13 comes to be securely pressed against the main connector housing 11, each of the engaging clip portions 22 of the cover 13 comes to clippingly engage into its corresponding slot 21 formed through the side of the main connector housing 11, thus securely coupling together said cover 13 and said main connector housing 11 and completing the assembly process. The projections of the parallel legs engage side walls of second aperture 17 of cover 13 when cable connection end 12a is initially being inserted into second aperture 17 and the projections of both of the legs clear the side walls to be positioned within slot 15 of cover 13 when cover 13 is fully fixed to housing 11.

The merit of the shown construction according to this preferred embodiment of the present invention is that, during this fitting operation of the cover 13 and the cable 14 to the main connector housing 11, the quite considerable inward pressing force inevitably exerted on each of the cable connecting elements 12 is conveniently absorbed by the pressing of its offsetting connecting portion 12d against the bottom of the depression 20 formed at the outer end (the lower end in FIGS. 2A and 2B) of the one of the apertures 16 into which said cable connecting element 12 is fitted, and is thus transferred to the connector main housing 11, thus reliably preventing that any of said inward pressing force should undesirably come to be exerted upon the central locating press fit portion 12c or upon the spring terminal contact end portion 12b of this cable connecting element 12. Accordingly, there is no risk of the spring terminal contact end portions 12b of the cable connecting elements 12 becoming deformed, or of losing their good spring quality and thus perhaps, during use of this cable connector, undesirably making poor contact with the male prongs of a male connector to which this female connector is coupled. Such male prongs, during use of this female connector, are slid into the upper end openings in FIGS. 2A and 2B of the apertures 16 in the connector main housing 11.

A further advantage inherent in the shown construction according to the present invention in which the bifurcate engaging tip portion 12a of each of the cable connecting elements 12 is located in a plane perpendicularly displaced from the rest of the cable connecting element 12 including its central locating press fit portion 12c and its spring terminal contact end portion 12b, is that, during the initial fitting stage for said cable connecting elements 12 into the connector main housing 11, greater force can be used without any risk of deformation or damage to said cable connecting elements 12, and thereby the assembly tools therefor can be simplified. In fact, it is not actually necessary fully to press each of said cable connecting elements 12 into its aperture 16 in the connector main housing 11, until finally the cover 13 and the cable 14 are to be coupled to said connector main housing 11, and accordingly the process of initial assembly of the connector can be simplified, and the assembly tools therefor may be further simplified.

Although the present invention has been shown and described in terms of the preferred embodiment thereof, and with reference to the appended drawings, it should not be considered as being particularly limited thereby; the scope of the present invention is to be considered as being delimited, not by any particular perhaps entirely fortuitous details of the disclosed preferred embodiment, or of the drawings, but solely by the scope of the accompanying claims, which follow.

What is claimed is:

1. A cable connector, comprising:

(a) a main housing formed with a first aperture;

(b) a cover formed with a slot for cable insertion and a second aperture opening to said slot;

(c) a means for fixing said cover to said main housing;

(d) a cable connecting element formed as an elongate member, one end thereof being adapted to be connected to a cable when pressed thereagainst, the other end thereof being adapted for external terminal contact, an intermediate portion thereof being adapted for press fitting, and a step portion thereof between said intermediate portion thereof and said cable connection end thereof functioning to perpendicularly displace the plane of said intermediate portion thereof from the plane of said cable connection end thereof;

(e) said cable connecting element being fitted into said first aperture of said main housing with its said intermediate portion being press fitted into said first aperture and its said external terminal contact end being housed in said first aperture, and with its said cable connection end protruding out from said first aperture for insertion into said second aperture of said cover and for coupling to a cable inserted into said slot of said cover, when said cover is secured to said main housing by said fixing means therefor, said cable connection end being bifurcated to include parallel legs (i) each having a projection on its outer side at an intermediate portion and (ii) comprising respective tip end portions, said projection of both of said legs for engaging side walls of said second aperture of said cover commencing at approximately the time said tip end portions of said cable connection end are initially being inserted into said slot and said projection of both of said legs clearing said side walls to be disposed within said slot of said cover when said cover is fully fixed to said housing.

2. A cable connector according to claim 1, wherein said step portion of said cable connecting element rests against the outside side of said main housing.

3. A cable connector according to claim 1, wherein said step portion of said cable connecting element rests in a depression formed in the outside side of said main housing.

4. A cable connector according to claim 1, wherein said cable connection end of said cable connecting element is bifurcate.

5. A cable connector according to claim 1, wherein said intermediate portion of said cable connecting element is wider than said external terminal contact end thereof.

* * * * *